US006152530A

United States Patent [19]

Hsu et al.

[11] Patent Number: 6,152,530

[45] Date of Patent: Nov. 28, 2000

[54] INFLATABLE FURNITURE HAVING INDEPENDENT AIR CHAMBERS

[75] Inventors: Yaw-Yuan Hsu, Taipei; Chin-Hsiang Pan, Taipei Hsien, both of Taiwan

[73] Assignee: Intex Recreation Corp., Long Beach, Calif.

[21] Appl. No.: 09/332,810

[22] Filed: Jun. 14, 1999

[51] Int. Cl.[7] ..... A47C 3/02

[52] U.S. Cl. ..... 297/272.3; 297/452.41

[58] Field of Search ..... 297/452.41, 272.3; 5/710, 654

[56] References Cited

U.S. PATENT DOCUMENTS

| | | | |
|---|---|---|---|
| 2,150,434 | 3/1939 | Finlay | 155/179 |
| 3,408,107 | 10/1968 | Savage | 297/452.41 |
| 3,428,974 | 2/1969 | Stuart | 5/348 |
| 3,499,682 | 3/1970 | Orenstein | 297/452.41 |
| 3,572,836 | 3/1971 | Khanh | 297/456 |
| 3,574,873 | 4/1971 | Weinstein | 5/348 |
| 3,584,914 | 6/1971 | Williams | 297/452.41 |
| 3,610,689 | 10/1971 | Smith | 297/452.41 |
| 3,740,095 | 6/1973 | Nail | 297/454 |
| 4,592,589 | 6/1986 | Hellwig | 297/284 |
| 4,639,960 | 2/1987 | Quillen et al. | 5/455 |
| 5,292,175 | 3/1994 | Artz | 297/250.1 |
| 5,303,435 | 4/1994 | Haar et al. | 5/710 X |
| 5,303,977 | 4/1994 | Sereboff | 297/230.1 |
| 5,360,360 | 11/1994 | Peterson | 441/130 |
| 5,556,169 | 9/1996 | Parrish et al. | 297/452.28 |
| 5,729,852 | 3/1998 | Rabideau et al. | 5/710 |
| 5,881,407 | 3/1999 | Chu | 5/654 |
| 5,947,563 | 9/1999 | Klimenko | 297/452.41 |
| 5,951,111 | 9/1999 | Klimenko | 297/452.41 |

*Primary Examiner*—Peter M. Cuomo
*Assistant Examiner*—Stephen Vu
*Attorney, Agent, or Firm*—Lewis, D'Amato, Brisbois, Bisgaard LLP

[57] ABSTRACT

An article of inflatable furniture having independent air chambers for supporting body weight and typically used in the domestic environment includes a plurality of air pressurized subchambers particularly positioned within an outer enclosing chamber for modify the shape of the outer enclosing chamber to obtain a cushioned, roll-up effect in the article of furniture. The article of inflatable furniture includes a bottom layer and an pressurized outer enclosing chamber sealed to the bottom layer. A seating surface is formed on the outer enclosing chamber for supporting the body weight of a person. A pair of independent, air pressurized subchambers are sealed to the bottom layer and extend upward into the outer enclosing chamber. The subchambers serve to increase the pressure within the outer enclosing chamber and to modify the shape of the outer enclosing chamber. A first alternative embodiment teaches the construction as applied to an inflatable sofa while a second alternative embodiment teaches the construction as applied to an inflatable mattress.

14 Claims, 8 Drawing Sheets

INFLATABLE FURNITURE HAVING INDEPENDENT AIR CHAMBERS

BACKGROUND OF THE INVENTION

1. Field of the Invention

The present invention relates to furniture. More specifically, the present invention relates to methods and apparatus for inflatable furniture having a plurality of independent air subchambers incorporated within an outer enclosing chamber, the subchambers functioning to increase the pressure within and to shape the outer enclosing chamber to provide a cushioned, roll-up effect to the furniture.

2. Description of the Prior Art

The prior art is directed to methods and apparatus for the construction of air filled furniture. Furniture designed to include air filled bladders and the like which are intended to support the body weight of a human are known in the art.

An example of air filled furniture known in the past was an air-filled "bean bag" style chair. The bean bag style chair typically was comprised of a material suitable for retaining air such as rubberized fabrics, some plastics or the like. Several sections of the selected material were cut into the proper shape from a pattern and then connected together as by sewing or by use of an adhesive to form the bag. The bean bag was partially inflated with air and was essentially shapeless. When a person would sit down onto the bean bag, the shapeless bag adapted to the shape of the body sitting thereon. The weight of the person sitting on the bean bag increased the air pressure inside the bean bag. The increased air pressure inside the bean bag pushed upwards with an equal and opposite force to support the weight of the person sitting on the bean bag.

Other pieces of furniture utilizing air pressure to support the weight of a body also have been known. For example, a pneumatic envelope means has been known to have been covered with a material fabric. The envelope means comprised one or more inflated tubes to support body weight. The inflated tubes could include a single serpentine-shaped tube that formed the shape of a chair or a plurality of tubes that form a seating or reclining surface. In another example, an inflatable couch furniture included a plurality of gas-tight independent and separately dilatable elements or flexible bags divided into compartments. The separate flexible bags were held together by, for example, rope to form the couch that served to support body weight.

A further example was an inflatable support structure intended for use in water. This structure included a buoyant inflatable flat central platform with separate surrounding peripheral compartments rising above the platform to form a reclining lounge having a back and sides. The inflatable compartments and platform directly supported the body weight of an individual reclining thereon. Yet another example included a reclining device typically used by convalescing patients which included an air inflatable recliner which provided support for the back, head, neck, legs and feet. The reclining device comprised three individual wedge-shaped, air-inflatable cushions interconnected together in a single vertical stack.

Other air-cushioned support systems for use in seating-type devices have also been known. In one air-cushioned arrangement, two contacting, gas filled layers are positioned in the upward extending portion of a chair which is intended to provide support to the back. The two-contacting, gas filled layers conform to the shape of the body with a plurality of beads in separate bag cushions. Another example includes a known inflatable child vehicle seat having inflatable bottom, back and side panels. An inflatable brace having a single interior air chamber is disposed in each side panel and communicates pneumatically with the other panels. Each of the inflatable chambers are connected for supporting the weight of the child.

Further examples are directed to air cushioned mattresses. One example is directed to a compartmented air mattress having a plurality of air tight compartments filled with air under pressure where each compartment includes a valve. In another example, a mattress for simulating flotation-type support is known. An elastic and flexible envelope includes an internal matrix which produces uniform pressure to minimize formation of decubitus ulcers. In another example, a flexible membrane is stuffed with air-filled elastic toy balloons to form a mattress has been known. In a final example, a seat cushion includes multiple adjacent chambers which can be inflated in a sequential or separate manner to adjust the air pressure as desired.

Thus, there is a need in the art for inflatable furniture having a plurality of independent air subchambers incorporated within an outer enclosing chamber, the subchambers functioning to increase the pressure within and to shape the outer enclosing chamber for providing a cushioned, roll-up effect to the furniture, can be formed from a suitable flexible material, and is economical to fabricate.

SUMMARY OF THE INVENTION

Briefly, and in general terms, the present invention provides a new and improved article of inflatable furniture having independent air chambers typically utilized in the domestic environment. However, the article of inflatable furniture can also be used around swimming pools and the beach. The novel and non-obvious article of inflatable furniture exhibits a bottom layer having an embossed surface and an outer enclosing chamber attached thereto by Radio Frequency sealing (hereinafter RF sealing) as is known in the art. A seating surface is formed on the outer enclosing chamber for use in supporting the body weight of an individual. A plurality of at least two independent air subchambers are sealed to the bottom layer as by RF sealing. The plurality of independent air subchambers extend from the bottom layer upward into the outer enclosing chamber, i.e., the plurality of subchambers are entirely surrounded by the outer enclosed chamber. However, the plurality of subchambers do not contact the outer enclosing chamber or any of the adjacent subchambers.

Each of the subchambers and the outer enclosing chamber are pressurized with a gas, in particular, air. When the plurality of subchambers are positioned within the outer enclosing chamber, the air within the outer enclosing chamber is forced upward. This action causes the air pressure within the outer enclosing chamber to increase. Each of the plurality of subchambers is independent and serves to increase the air pressure in the outer enclosing chamber in the area above the particular subchamber. Thus, by positioning a subchamber at a particular location within the outer enclosing chamber, the shape or form of the outer enclosing chamber can be modified. Therefore, the function of the plurality of subchambers particularly positioned within the outer enclosing chamber is to modify the shape of the outer enclosing chamber to obtain a cushioned, roll-up effect.

By modifying the shape of the outer enclosing chamber, the article of inflatable furniture can include such features as arm rests, a back support, a leg support and a seating surface without the use of other structural components. The seating surface is formed by connecting the outer enclosing chamber to the bottom layer with a pair of anchor sheets. Thus, conformity of the shape of the article of inflatable furniture including the seating surface is maintained even when it is not being utilized. The plurality of subchambers are not compressed since the outer enclosing chamber supports the body and the limbs. Each of the plurality of subchambers and the outer enclosing chamber include an air valve and each is fabricated from a flexible material such as polyvinylchloride (PVC). The outer enclosing chamber also includes an exhaust valve for rapid deflation. Additional subchambers can be included in the outer enclosing chamber to provide additional support.

The present invention is generally directed to an article of inflatable furniture having independent air chambers, in particular, an inflatable chair. In its most fundamental embodiment, the article of inflatable furniture comprises a construction having a bottom layer and an outer enclosing chamber sealed to the bottom layer. The outer enclosing chamber is pressurized with air. A seating surface is formed on the outer enclosing chamber for supporting the body weight of a person. A pair of independent, air pressurized subchambers are sealed to the bottom layer and extend upward into the outer enclosing chamber. The subchambers serve to increase the pressure within the outer enclosing chamber and to modify the shape of the outer enclosing chamber.

In a first alternative embodiment, the article of inflatable furniture having independent air chambers is, in particular, an inflatable sofa. The inflatable sofa includes a bottom layer having an outer enclosing chamber attached thereto by RF sealing and a seating surface formed on the outer enclosing chamber. A plurality of three independent, air pressurized subchambers are RF sealed to the bottom layer and extend upward into the outer enclosing chamber for increasing the pressure within and for modifying the shape of the outer enclosing chamber. In a second alternative embodiment, the article of inflatable furniture having independent air chambers is, in particular, an inflatable mattress. The construction also includes a bottom layer sealed to an outer enclosing chamber and a plurality of four independent, air pressurized subchambers for increasing the air pressure and for modifying the shape of the outer enclosing chamber. However, the inflatable mattress of the second alternative embodiment replaces the seating surface with a reclining surface.

These and other objects and advantages of the present invention will become apparent from the following more detailed description, taken in conjunction with the accompanying drawings which illustrate the invention, by way of example.

DESCRIPTION OF THE INVENTION

Figure 1:
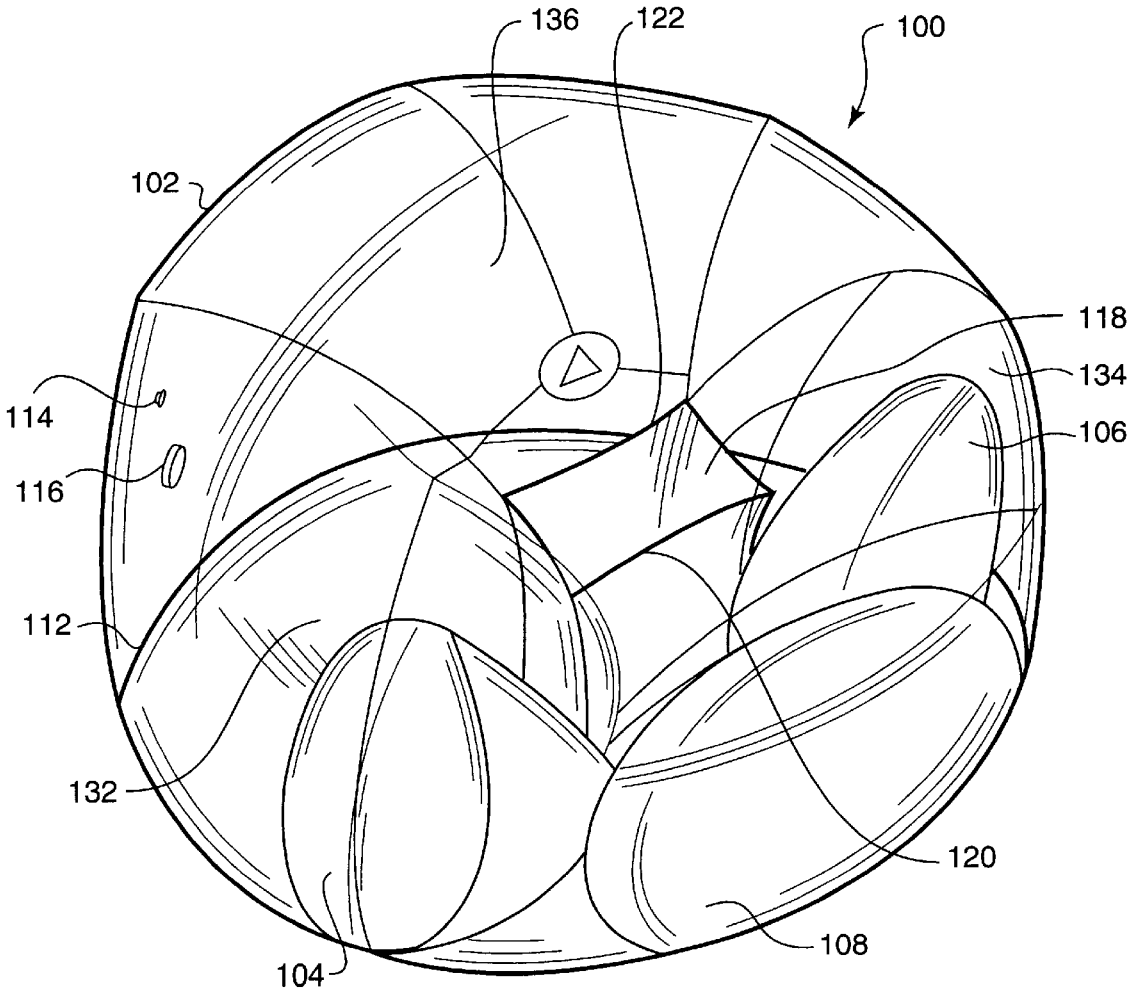
FIG. 1 is a front perspective view of a preferred embodiment of an article of inflatable furniture having independent air chambers of the present invention shown in the form of an inflatable chair having three air subchambers incorporated within an outer enclosing chamber and a built-in seating surface.
Figure 2:
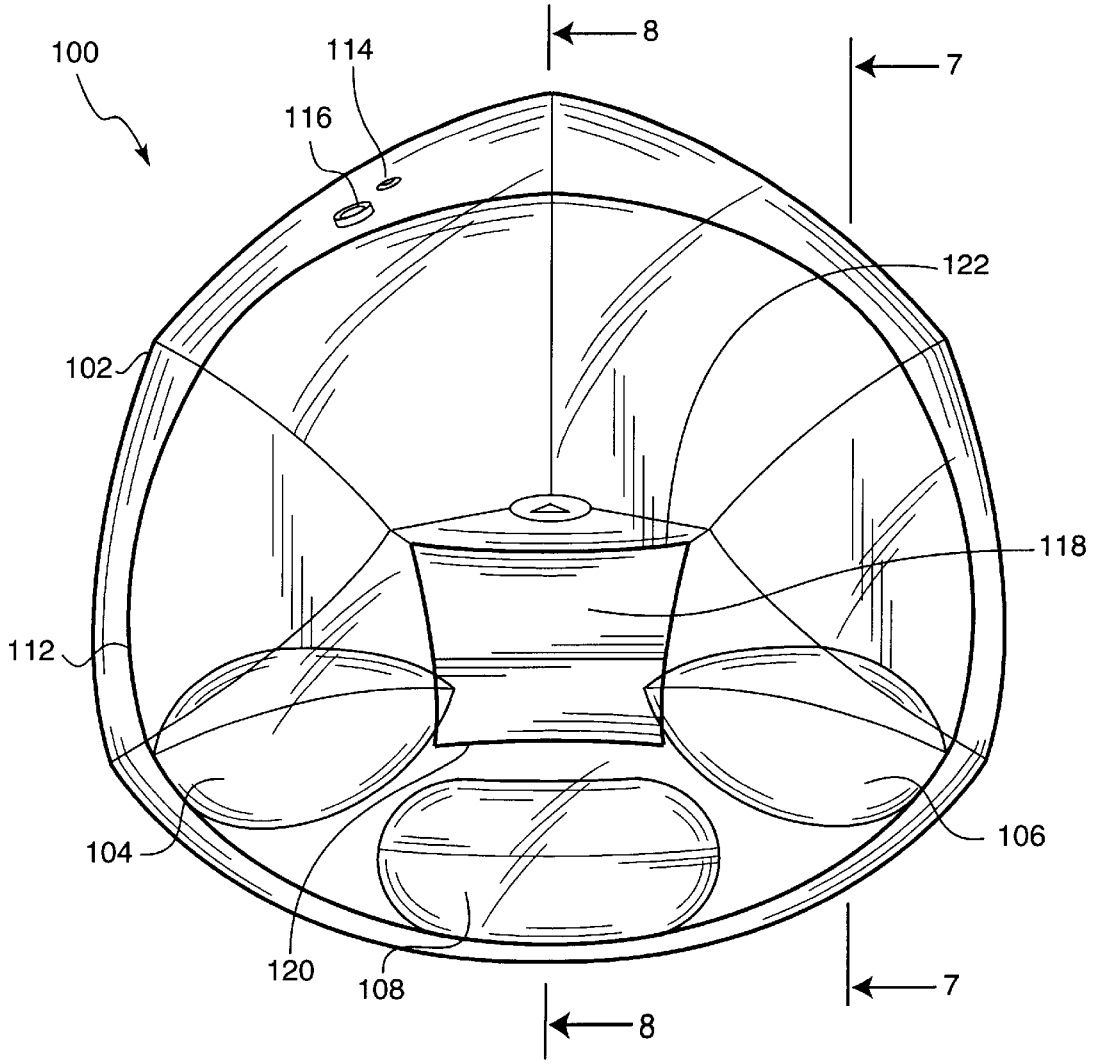
FIG. 2 is a top planar view of the article of inflatable furniture of FIG. 1 showing the three air subchambers incorporated within the outer enclosing chamber and the built-in seating surface.
Figure 3:
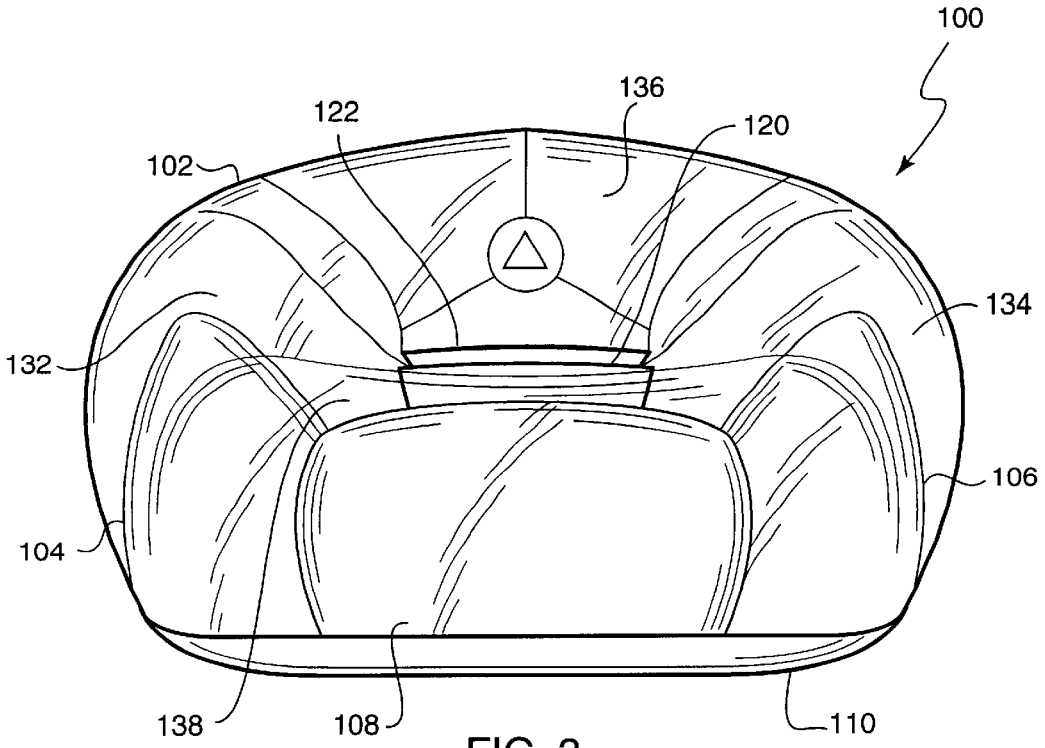
FIG. 3 is a front elevational view of the article of inflatable furniture of FIG. 1 showing the three air subchambers incorporated within the outer enclosing chamber, the built-in seating surface and a back support.

The present invention is an article of inflatable furniture 100 having a plurality of independent air chambers as shown in FIGS. 1–4. The independent air chambers include an outer enclosing chamber 102 and a single or a plurality of independent air subchambers housed entirely within the outer enclosing chamber 102 as best shown in FIG. 1. In the preferred embodiment of the present invention, the article of inflatable furniture 100 includes at least two independent air subchambers in order to provide conformity and balance thereto. However, use of a single independent air subchamber or use of four or more independent air subchambers is deemed to be within the scope and spirit of the present invention. Thus, the structure and operation described hereinbelow applies equally to embodiments having a single independent air subchamber and to embodiments having multiple independent air subchambers. For purposes of simplifying the description presented herein, three independent air subchambers are shown in FIGS. 1–8 of the preferred embodiment. Those independent air subchambers include a first lateral subchamber 104, a second lateral subchamber 106 and a front subchamber 108 as is shown in FIGS. 1–3.

Figure 4:
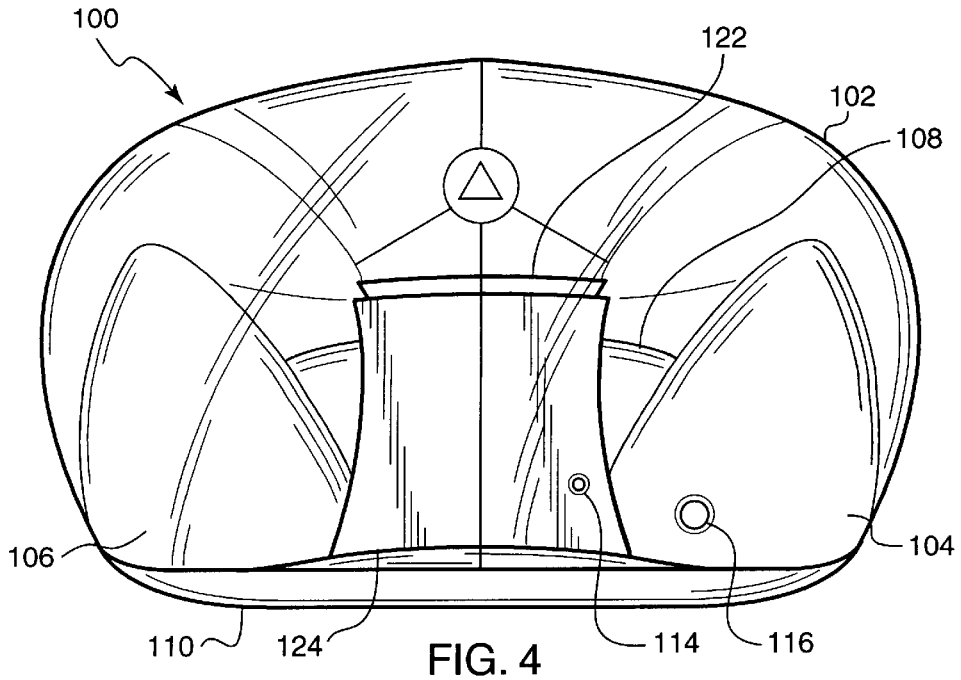
FIG. 4 is a rear elevational view of the article of inflatable furniture of FIG. 1 showing two of the three air subchambers incorporated within the outer enclosing chamber and one of a pair of anchor sheets utilized to form the built-in seating surface.
Figure 5:
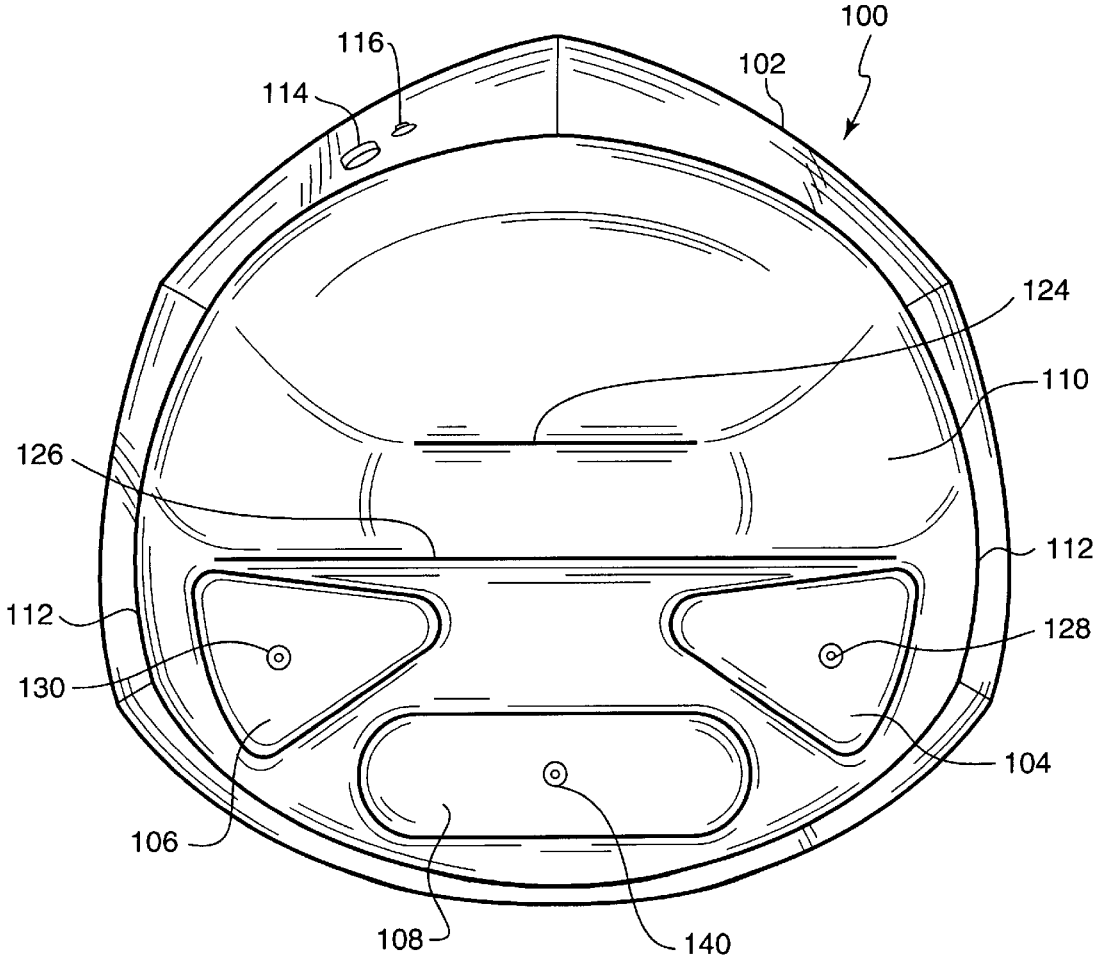
FIG. 5 is a bottom planar view of the article of inflatable furniture of FIG. 1 showing an embossed bottom surface and the outline of the three air subchambers with an air intake valve mounted in the bottom of each subchamber and an air intake valve and exhaust valve mounted in the rear of the outer enclosing chamber.
Figure 6:
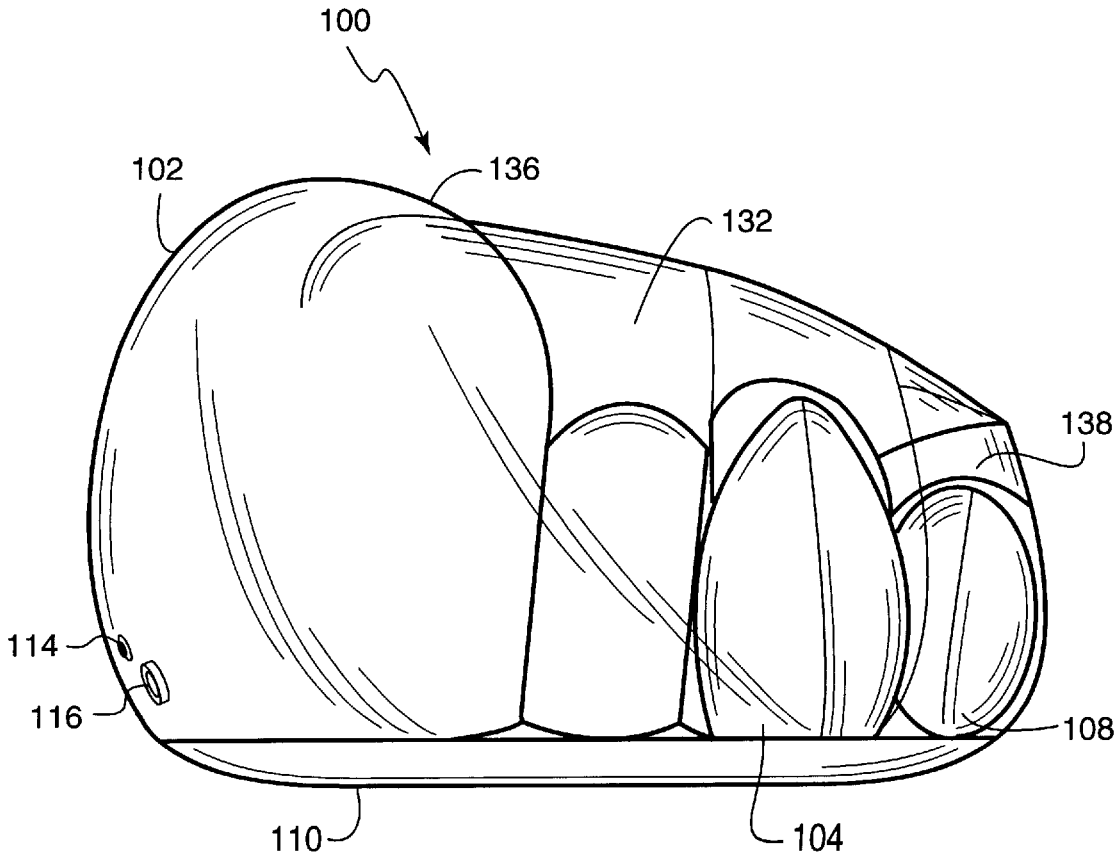
FIG. 6 is a right side elevational view of the article of inflatable furniture of FIG. 1 showing two of the three air subchambers incorporated within the outer enclosing chamber and the pair of anchor sheets, a left side elevational view being a mirror image thereof.
Figure 7:
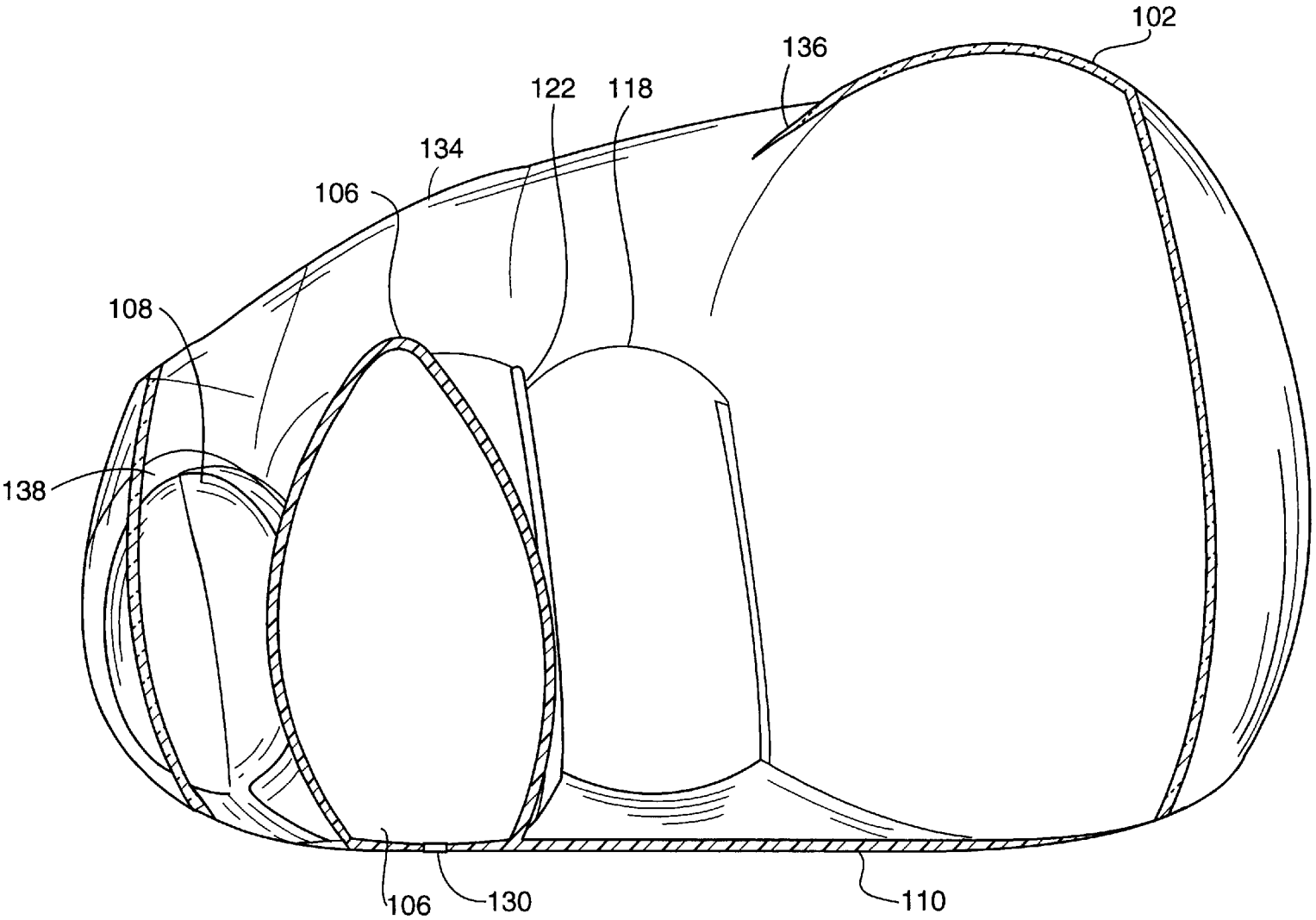
FIG. 7 is a first longitudinal cross-sectional view of the article of inflatable furniture of FIG. 1 taken along line 7—7 of FIG. 2 and showing a left side arm rest formed by the air subchambers within the outer enclosing chamber, the pair of anchor sheets and the back support.

The article of inflatable furniture 100 includes a common bottom layer 110 which can be seen in FIGS. 3, 4 and 6 but is shown best in FIG. 5. The bottom layer 110 is an essentially flat, embossed, single polyvinylchloride (hereinafter PVC) plastic layer. As it relates to the bottom layer 110, embossing means that the surface has been rolled (during the manufacturing process) so that it is not entirely smooth. Thus, the bottom layer 110 has a somewhat ruddy outer surface texture about it. It is noted that each of the structural components included within the preferred embodiment of the article of inflatable furniture 100 is fabricated from PVC plastic. However, any suitable flexible material capable of being sealed against leakage of a gas, particularly air, can be utilized.

The outer enclosing chamber 102 is comprised of a single layer of PVC plastic and is employed to cover and enclose each of the remaining structural components included within the article of inflatable furniture 100. Thus, the outer enclosing chamber 102 fits over the bottom layer 110 somewhat like a non-spherical dome as shown in FIG. 1. It is noted that the outer enclosing chamber 102 is shown in the accompanying drawing FIGS. 1–10 as being transparent. In reality, the outer enclosing chamber 102 would not be transparent, i.e., the outer enclosing chamber 102 would be opaque. However, to facilitate the disclosure of the interior structural components, the outer enclosing chamber 102 has been shown as transparent. Notwithstanding, the structural combination remains the same whether the outer enclosing chamber 102 is transparent or not.

The outer enclosing chamber 102 is bonded or fused to the common bottom layer 110 at an interface 112 of their respective outer perimeters by radio frequency sealing or welding (hereinafter RF sealing). The interface 112 is clearly shown in FIG. 5. Further, all seams and seals required to be bonded in the present invention as shown in the drawing Figs. are bonded by RF sealing. RF sealing of PVC plastic components is well known in the art. RF sealing has been selected to bond the PVC plastic structural components together in the article of inflatable furniture 100 because of its bonding strength. This is important since the outer enclosing chamber 102 is pressurized with a gas, in particular, air. Therefore, the RF seal formed between the components, i.e., for example the interface 112 between the outer enclosing chamber 102 and the bottom layer 110, must be robust. To facilitate the injection of air into the outer enclosing chamber 102, an air inlet valve 114 is mounted on the side of the outer enclosing chamber 102 as is clearly shown in FIGS. 1, 2, 4, 5, and 6. Mounted adjacent to the air inlet valve 114 on the outer enclosing chamber 102 is a main exhaust valve 116 used to accelerate the air deflation of the outer enclosing chamber 102.

Figure 8:
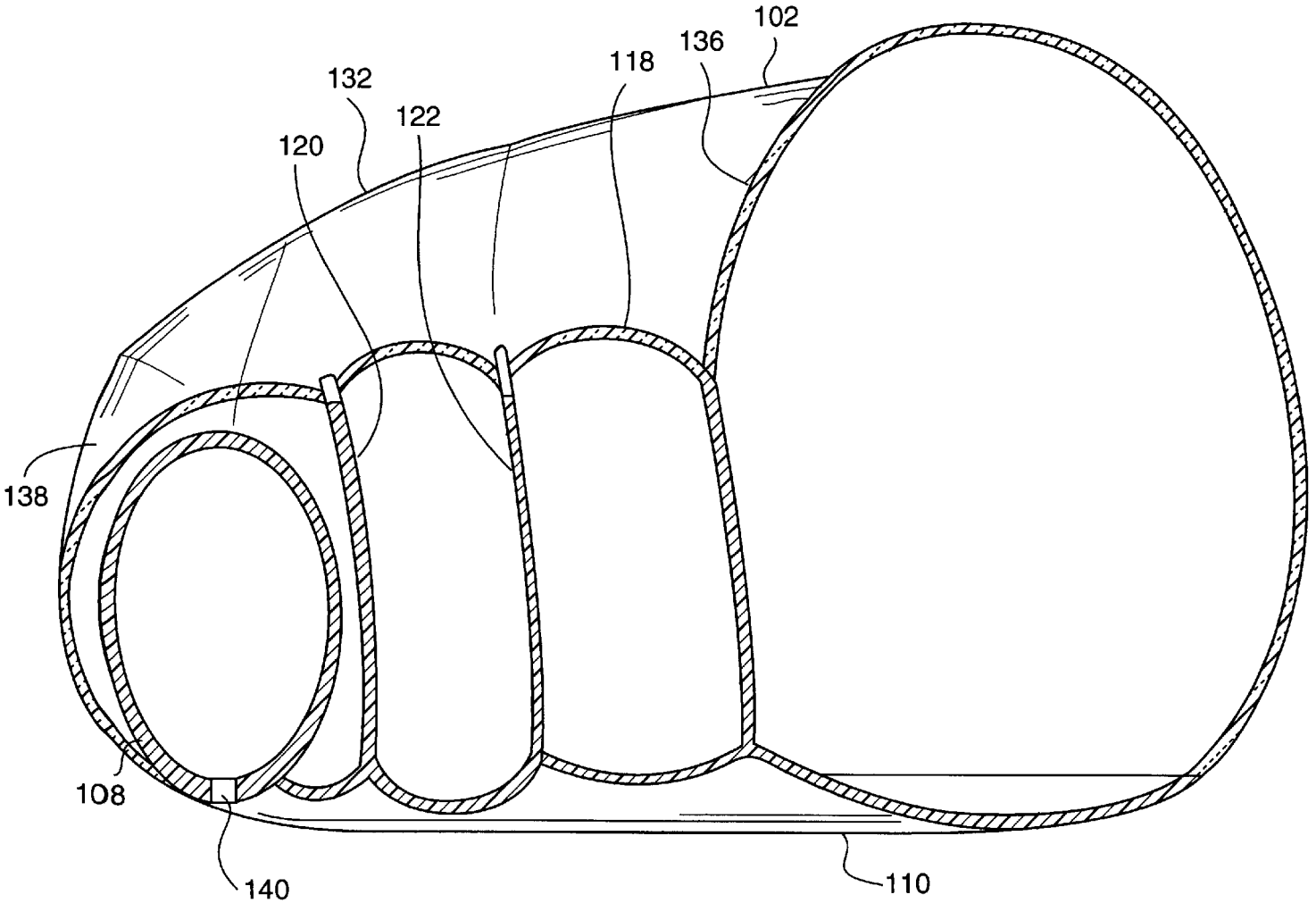
FIG. 8 is a second longitudinal cross-sectional view of the article of inflatable furniture of FIG. 1 taken along line 8—8 of FIG. 2 and showing one of the three air subchambers incorporated within the outer enclosing chamber, the two anchor sheets, a right side arm rest and the back support.

A seating surface 118 is formed on the upper frontal area of the outer enclosing chamber 102 as is clearly shown on FIGS. 1 and 2 and in the cross-sectional view of FIG. 8. The seating surface 118 is formed in the following manner. The outer enclosing chamber 102 is attached to the bottom layer 110 by a pair of anchor sheets 120 and 122 shown best in FIGS. 1 and 4. Each of the anchor sheets 120 and 122 are fashioned from PVC plastic so that they are compatible with the remainder of the components of the article of inflatable furniture 100. Each of the anchor sheets 120 and 122 are RF sealed in parallel to the outer enclosing chamber 102 and to the bottom layer 110 as is clearly shown in FIG. 4. The bottom of the anchor sheet 122 has a broader width dimension 124 for RF sealing to the bottom layer 110 as compared to the top of the anchor sheet 122 as is also clearly shown in FIG. 4. Likewise, the bottom of the anchor sheet 120 has a broader width dimension 126 than the top width dimension of anchor sheet 120 for sealing to the bottom layer 110 as is shown in FIG. 5. The position of the anchor sheets 120 and 122 is clearly shown in FIG. 8. As a result, the anchor sheets 120 and 122 serve to manipulate the shape of the outer enclosing chamber 102 to form the seating surface 118 best shown in FIGS. 1 and 2. Further, the anchor sheets 120 and 122 provide conformity to the shape of the article of inflatable furniture 100 since the seating surface 118 is identifiable as a seating surface even if a body is not seated on the outer enclosing surface 102.

The function of the plurality of the independent air subchambers will now be discussed. Initially, the preferred embodiment using only the first lateral subchamber 104 and the second lateral subchamber 106 will be discussed. It is emphasized that the plurality of air subchambers are independent. Independent, in this situation, is defined as each air subchamber is a separate, inflatable component that is physically attached to the bottom layer 110 via RF sealing. However, each of the air subchambers does not physically contact the outer enclosing chamber 102 or any of the adjacent air subchambers. Thus, each of the independent air subchambers rise from the bottom layer 110 but terminate before reaching the outer enclosing chamber 102. Further, each of the air subchambers is charged with air, i.e., pressurized, and consequently extends upward occupying space within the volume of the outer enclosing chamber 102. Additionally, when pressurized, each air subchamber extends below the level of the bottom layer 110 as is shown in FIGS. 5 and 6. Finally, each of the air subchambers includes an air intake valve to facilitate charging the subchamber with air.

The first lateral subchamber 104 includes an air inlet valve 128 and the second lateral subchamber 106 includes an air inlet valve 130 as is clearly shown in FIG. 5. Thus both the first lateral subchamber 104 and the second lateral subchamber 106 are individually pressurized and extend upward from the bottom layer 110 as shown in FIG. 1. By necessity, both the first lateral subchamber 104 and the second lateral subchamber 106 occupy space within the outer enclosing chamber 102. Since the first lateral subchamber 104 and the second lateral subchamber 106 are positioned within the outer enclosing chamber 102, the air within the outer enclosing chamber 102 is forced upward increasing the air pressure therein.

The increased pressure within the outer enclosing chamber 102 causes the shape of the outer enclosing chamber 102 to change. Thus, positioning the first lateral subchamber 104 and the second lateral subchamber 106 at particular locations on the bottom layer 110 within the outer enclosing chamber 102 enables the shape of the outer enclosing chamber 102 to be modified as desired. Positioning the first lateral subchamber 104 and the second lateral subchamber 106 as shown in FIGS. 1–4 enable the formation of a first arm rest 132 and a second arm rest 134 in the outer enclosing chamber 102 as is best shown in FIG. 3 but also shown in FIGS. 6–8. Further, anchor sheets 120 and 122, which form the seating surface 118, pull down on the upper surface of the outer enclosing chamber 102. This pulling down on the outer enclosing chamber 102 combined with the increased air pressure caused by the first lateral subchamber 104 and the second lateral subchamber 106 enable the formation of a back support 136. Consequently, use of the first lateral subchamber 104 and the second lateral subchamber 106 with the assistance of the anchor sheets 120 and 122 creates the desired shape of the outer enclosing chamber 102, i.e., the cushioned, roll-up effect. When a body is positioned upon the article of inflatable furniture 100, it is the outer enclosing chamber 102 that supports the weight, not the first lateral subchamber 104 and the second lateral subchamber 106. It is noted that in the absence of the first lateral subchamber 104 and the second lateral subchamber 106, the top surface of the outer enclosing chamber 102 would flatten and provide minimal support.

The front subchamber 108 is a third air subchamber and can be added if desired. The front subchamber 108 is positioned within the outer enclosing chamber 102 forward of the seating surface 118 as shown in FIGS. 1–3. Utilizing the same type of construction as previously described, the front subchamber 108 is an independent air subchamber which is RF sealed to the bottom layer 110. The front subchamber 108 extends upwards into the outer enclosing chamber 102 but does not contact the outer enclosing chamber 102 or any of the adjacent subchambers. The front subchamber 108 serves to increase the air pressure within the outer enclosing chamber 102 directly above the position of the front subchamber 108. Use of the front subchamber 108 at this location serves to create a leg support 138 (best shown in FIGS. 3 and 6) which compliments the first arm rest 132, the second arm rest 134 and the back support 136 previously described. An air inlet valve 140 is positioned within the front subchamber 108 as shown in FIGS. 5 and 8 for increasing the air pressure. The increased air pressure within the outer enclosing chamber 102 functions to push back on and thus support the body seated thereon. As with all the other independent air subchambers, the front subchamber 108 is not compressed but serves only to increase the air pressure within the outer enclosing chamber 102. In all situations, the outer enclosing chamber 102 functions to support the body weight of the person seated on the article of inflatable furniture 100.

It is noted that a fourth independent air subchamber can be added to the construction shown in FIG. 1. The fourth subchamber (not shown) could be positioned behind the seating surface 118 beneath the area of the existing back support 136 as shown in FIGS. 1 and 3. By adding a fourth air subchamber behind the seating surface 118, the air pressure within the outer enclosing chamber 102 in the area of the existing back support 136 would increase. This increase in air pressure would effectively stiffen the back support 136 providing additional support to the back of the body resting on the article of inflatable furniture 100.

Figure 9:
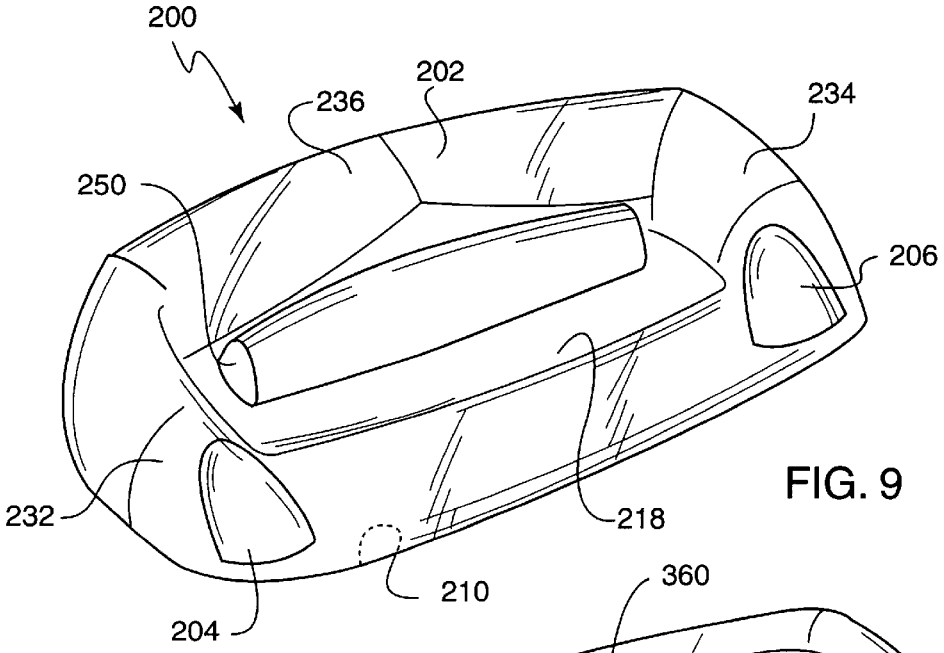
FIG. 9 is a front perspective view of a first alternative embodiment of an article of inflatable furniture having independent air chambers of the present invention shown in the form of an inflatable sofa having three air subchambers incorporated within an outer enclosing chamber and a built-in seating surface.

A first alternative embodiment of the article of inflatable furniture of the present invention is shown in FIG. 9 and is referred to by the identification number 200. Each of the components appearing in the alternative embodiment 200 that correspond in structure and function to those components appearing in the preferred embodiment 100 is identified by the corresponding number of the 200 series.

The article of inflatable furniture appearing in the first alternative embodiment 200 of the present invention manifests itself in an inflatable sofa or couch as is shown in FIG. 9. As in the preferred embodiment 100, the article of inflatable furniture 200 comprises a plurality of independent air chambers. The plurality of independent air chambers includes a pressurized outer enclosing chamber 202 and a plurality of pressurized, independent air subchambers. The plurality of independent air subchambers includes a first lateral subchamber 204, a second lateral subchamber 206 and a rear subchamber 250.

The outer enclosing chamber 202 is comprised of a single layer of PVC plastic and is shown as transparent for illustration purposes only. Typically, the outer enclosing chamber 202 would be opaque. As in the preferred embodiment 100, the outer enclosing chamber 202 is bonded to a bottom layer 210 as by RF sealing. Thus, each of the independent air subchambers, i.e., the first lateral subchamber 204, the second lateral subchamber 206 and the rear subchamber 250, are enclosed within the outer enclosing chamber 202. The independent air subchambers 204, 206 and 250 and the outer enclosing layer 202 each include an inlet air valve (not shown) for pressurizing the respective chamber. Likewise, the outer enclosing layer 202 can also include a main exhaust valve (not shown) for rapid deflation of the article of inflatable furniture 200.

The first lateral subchamber 204, the second lateral subchamber 206 and the rear subchamber 250 are each bonded to the bottom layer 210 as by RF sealing and extend upward when pressurized but do not contact the outer enclosing chamber 202. The function of each of the pressurized, independent air subchambers 204, 206 and 250 is to increase the pressure in a particular location within the outer enclosing chamber 202. By increasing the pressure at particular locations within the outer enclosing chamber 202, the shape of the outer enclosing chamber 202 can be modified as desired.

In the article of inflatable furniture 200 of the present invention, the first lateral subchamber 204 is positioned to create increased pressure that will result in a first arm rest 232 as shown in FIG. 9. Likewise, the second lateral subchamber 206 is positioned to create increased pressure in the outer enclosing chamber 202 that will result in a second arm rest 234. The rear subchamber 250 is a long extended subchamber and serves to increase the pressure in the outer enclosing chamber 202 of the article of inflatable furniture 200 so as to form a back support 236. The combination of the first lateral subchamber 204, the second lateral subchamber 206 and the rear subchamber 250 also provide a seating surface 218 as shown in FIG. 9. A plurality of anchor sheets or similar devices (not shown) can be employed to assist in the formation of the seating surface 218.

The combination of each of the above described features provides for a cushioned, roll-up effect in the article of inflatable furniture 200. However, additional independent, air subchambers can be located in other parts of the article of inflatable furniture 200. As an example, a fourth subchamber (not shown) could be located in the area of the article of inflatable furniture 200 that would provide a leg support.

Figure 10:
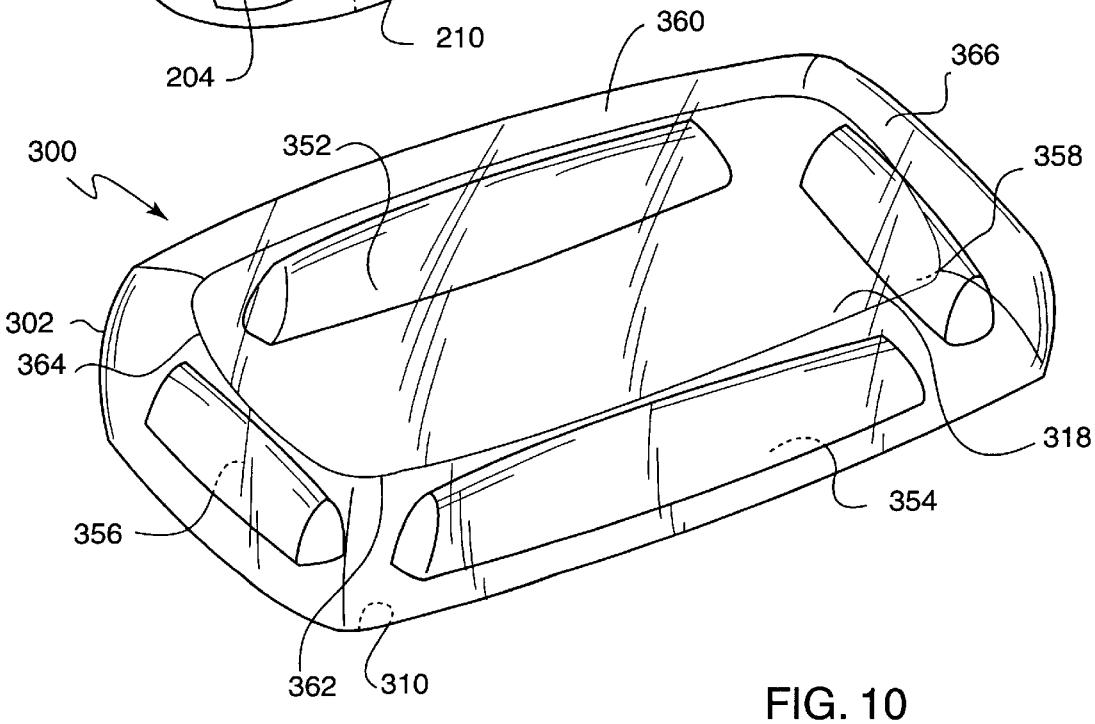
FIG. 10 is a front perspective view of a second alternative embodiment of an article of inflatable furniture having independent air chambers of the present invention shown in the form of an inflatable mattress having four air subchambers incorporated within an outer enclosing chamber and a built-in reclining surface.

A second alternative embodiment of the article of inflatable furniture of the present invention is shown in FIG. 10 and is referred to by the identification number 300. Each of the components appearing in the alternative embodiment 300 that correspond in structure and function to those components appearing in the preferred embodiment 100 is identified by the corresponding number of the 300 series.

The article of inflatable furniture appearing in the second alternative embodiment 300 of the present invention manifests itself in an inflatable mattress as is shown in FIG. 10. As in the preferred embodiment 100, the article of inflatable furniture 300 comprises a plurality of independent air chambers. The plurality of independent air chambers includes a pressurized outer enclosing chamber 302 and a plurality of pressurized, independent air subchambers. The plurality of independent air subchambers includes a first side subchamber 352, a second side subchamber 354, a first end subchamber 356 and a second end subchamber 358. The outer enclosing chamber 302 is comprised of a single layer of PVC plastic and is shown as transparent for illustration purposes only. Typically, the outer enclosing chamber 302 would be opaque. As in the preferred embodiment 100, the outer enclosing chamber 302 is bonded to a bottom layer 310 as by RF sealing. Thus, each of the independent air subchambers, i.e., the first side subchamber 352, the second side subchamber 354, the first end subchamber 356 and the second end subchamber 358, are enclosed within the outer enclosing chamber 302. The independent air subchambers 352, 354, 356 and 358 and the outer enclosing layer 302 each include an inlet air valve (not shown) for pressurizing the respective chamber. Likewise, the outer enclosing layer 302 can also include a main exhaust valve (not shown) for rapid deflation of the article of inflatable furniture 300.

The first side subchamber 352, the second side subchamber 354, the first end subchamber 356 and the second end subchamber 358 are each bonded to the bottom layer 310 as by RF sealing and extend upward when pressurized but do not contact the outer enclosing chamber 302. The function of each of the pressurized, independent air subchambers 352, 354, 356 and 358 is to increase the pressure in a particular location within the outer enclosing chamber 302. By increasing the pressure at particular locations within the outer enclosing chamber 302, the shape of the outer enclosing chamber 302 can be modified as desired.

In the article of inflatable furniture 300 of the present invention, the first side subchamber 352 is positioned to create increased pressure that will result in a first side boundary 360 as shown in FIG. 10. Likewise, the second side subchamber 354 is positioned to create increased pressure in the outer enclosing chamber 302 that will result in a second side boundary 362. The first end subchamber 356 serves to increase the pressure in the outer enclosing chamber 302 in the article of inflatable furniture 300 so as to form a first end boundary 364 as shown in FIG. 10. Finally, the second end subchamber 358 serves to increase air pressure in the outer enclosing chamber 302 so as to form a second end boundary 366. The combination of the first side subchamber 352, the second side subchamber 354, the first end subchamber 356 and the second end subchamber 358 also provide a reclining surface 318 as shown in FIG. 10. A plurality of anchor sheets or similar devices (not shown) can be employed to assist in the formation of the reclining surface 318.

The combination of each of the above described features provides for a cushioned, roll-up effect in the article of inflatable furniture 300. However, additional independent, air subchambers can be located in other parts of the article of inflatable furniture 300. As an example, additional subchambers (not shown) could be located in the corner areas of the mattress which comprises the article of inflatable furniture 300. These additional corner subchambers (not shown) would provide additional support to the structure.

The present invention provides novel advantages over other conventional inflatable furniture known in the art. A main advantage of the article of inflatable furniture 100 of the present invention is that a plurality of subchambers 104, 106, 108 can be particularly positioned within the outer enclosing chamber 102 to increase the pressure within the outer enclosing chamber 102 for modifying the shape of the outer enclosing chamber 102 to obtain a cushioned, roll-up effect. By modifying the shape of the outer enclosing chamber 102, the article of inflatable furniture 100 can include the first arm rest 132, the second arm rest 134, the back support 136, and the leg support 138. Further, the seating surface 118 is formed by connecting the outer enclosing chamber 102 to the bottom layer 110 with a pair of anchor sheets 120 and 122. Thus, conformity of the shape of the article of inflatable furniture 100 including the seating surface 118 is maintained even when it is not being utilized. The plurality of subchambers 104, 106, 108 are not compressed since the outer enclosing chamber 102 supports the weight of the users body and the limbs. Each of the plurality of subchambers 104, 106, 108 and the outer enclosing chamber 102 include air valves 128, 130, 140, and 114, respectively, and each is fabricated from a flexible material such as polyvinylchloride (PVC). The outer enclosing chamber 102 also includes an exhaust valve 116 for rapid deflation. Additional subchambers can be included in the outer enclosing chamber 102 to provide additional support, if desired.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

We claim:

1. An article of inflatable furniture having independent air chambers comprising:

a common bottom layer;

an outer enclosing chamber sealed to said common bottom layer, said outer enclosing chamber being pressurized with air;

a seating surface formed on said outer enclosing chamber for supporting weight; and an independent, air pressurized subchamber sealed to said common bottom layer and extending upward into but not contacting said outer enclosing chamber, said subchamber for increasing the pressure within and for modifying the shape of said outer enclosing chamber.

2. The article of inflatable furniture of claim 1 wherein said outer enclosing chamber includes an air valve.

3. The article of inflatable furniture of claim 1 wherein said outer enclosing chamber includes an exhaust valve.

4. The article of inflatable furniture of claim 1 wherein said air pressurized subchamber includes an air valve.

5. The article of inflatable furniture of claim 1 wherein said outer enclosing chamber includes a right side arm rest.

6. The article of inflatable furniture of claim 1 wherein said outer enclosing chamber includes a left side arm rest.

7. The article of inflatable furniture of claim 1 wherein said outer enclosing chamber includes a back support.

8. The article of inflatable furniture of claim 1 wherein said seating surface is formed by a plurality of anchor sheets connecting said outer enclosing chamber to said bottom layer.

9. The article of inflatable furniture of claim 1 wherein said bottom layer is comprised of polyvinylchloride.

10. The article of inflatable furniture of claim 1 wherein said outer enclosing chamber is comprised of polyvinylchloride.

11. The article of inflatable furniture of claim 1 wherein said seating surface is comprised of polyvinylchloride.

12. The article of inflatable furniture of claim 1 wherein said air pressurized subchamber is comprised of polyvinylchloride.

13. An article of inflatable furniture having independent air chambers comprising:

a common bottom layer;

an outer enclosing chamber sealed to said common bottom layer, said outer enclosing chamber being pressurized with air;

a seating surface formed on said outer enclosing chamber for supporting weight; and a plurality of independent, air pressurized subchambers sealed to said common bottom layer and extending upward into but not contacting said outer enclosing chamber, said subchambers for increasing the pressure within and for modifying the shape of said outer enclosing chamber.

14. An article of inflatable furniture having independent air chambers comprising:

a common bottom layer;

an outer enclosing chamber sealed to said common bottom layer, said outer enclosing chamber being pressurized with air;

a reclining surface formed on said outer enclosing chamber for supporting weight; and a plurality of independent, air pressurized subchambers sealed to said common bottom layer and extending upward into but not contacting said outer enclosing chamber, said subchambers for increasing the pressure within and for modifying the shape of said outer enclosing chamber.

* * * * *